US005191253A

United States Patent [19]

Kang

[11] Patent Number: 5,191,253

[45] Date of Patent: Mar. 2, 1993

[54] DEFLECTION YOKE HAVING A TIGHT COUPLER

[75] Inventor: Jaeho Kang, Kyunggi, Rep. of Korea

[73] Assignee: Samsung Electron Devices Co., Ltd., Kyunggi, Rep. of Korea

[21] Appl. No.: 726,756

[22] Filed: Jul. 8, 1991

[30] Foreign Application Priority Data

Dec. 6, 1990 [KR] Rep. of Korea ..... 90-19375

[51] Int. Cl.[5] ..... H01J 29/70

[52] U.S. Cl. ..... 313/440; 335/210; 358/249

[58] Field of Search ..... 313/440, 482; 358/248, 358/249; 335/210, 213; 411/269, 306

[56] References Cited

U.S. PATENT DOCUMENTS 3,761,848 9/1973 Sugiura ..... 335/210
3,777,356 12/1973 Hemingway ..... 411/306
3,939,447 2/1976 D'Amato ..... 335/210
4,612,524 12/1986 Groothoff ..... 335/210

FOREIGN PATENT DOCUMENTS 61-7703 11/1986 Japan .
62-7658 11/1987 Japan .
0301450 12/1988 Japan ..... 313/440

*Primary Examiner*—Donald J. Yusko
*Assistant Examiner*—Michael Horabik
*Attorney, Agent, or Firm*—Christie, Parker & Hale

[57] ABSTRACT

A deflection yoke has a tight coupler is provided. On periphery of a neck holder of the deflection yoke of a cathode ray tube, tapered threads are formed on threaded members on which a locking nut can be throttled. Peripheral slots are provided around the threads to enable compression of the threads. As a locking nut is screwed on the tapered threads, the threads compress and tighten around the neck of the cathode ray tube, firmly securing the deflection yoke to the periphery of the neck of the cathode ray tube. Protrusions on one end of the threads act as a stop for the locking nut and also hold a magnetic ring in place on the CRT.

2 Claims, 3 Drawing Sheets

DEFLECTION YOKE HAVING A TIGHT COUPLER

FIELD OF THE INVENTION

The present invention relates to a cathode ray tube deflection yoke, and particularly to a deflection yoke having a tight coupler clamped around the circumference of the neck of the cathode ray tube.

BACKGROUND OF THE INVENTION

A deflection yoke is installed on the periphery of the neck of a cathode ray tube to direct or scan electron beams from an electron gun on a fluorescent screen inside a panel.

A deflection yoke is formed by perpendicularly attaching a vertical deflection coil and a horizontal deflection coil on a separator. Generally, the deflection yoke can be mounted on the neck portion of a cathode ray tube by a clamp band extending around the periphery of the neck holder of the separator, so that the yoke is held in place by clamping force.

For example, as shown in U.S. Pat. No. 3,761,848, a clamp band may comprise a metal ring with one open side, the band being held by an engaging bolt.

However, this type of clamp band used as a fixing tool of the deflection yoke is undesirable due to complicated operation. Also, since a clamp band made of metal becomes magnetized if used long, the clamp band may degrade the picture quality.

U.S. Pat. No. 3,939,447 discloses a platform adhered to the neck of a cathode ray tube instead of a clamp band. After housing the deflection yoke by several springs formed on the platform, the deflection yoke is fixed on the neck of the cathode ray tube by an adhesive.

Though the above method has an advantage in easily disposing the deflection yoke on the neck of cathode ray tubes, the strength of fixation of the deflection yoke depends on the quality of the adhesive. Moreover, since the adhesives typically used may contaminate the working environment, the amount of adhesives used is preferably controlled if possible.

The present invention is to provide the deflection yoke with a tight coupler which is convenient for fixing the deflection yoke and which can be made of an unmagnetic substance.

SUMMARY OF THE INVENTION

The present invention provides forming tapered threads in separate compressible members on a neck holder of a cathode ray tube and throttling or closing the tapered threads members by a locking nut which encircles all the segments. The tapered threaded members are separated, by slot in three directions, from the periphery of the neck of a cathode ray tube, so that the slots are compressed by the locking nut to tightly grip the periphery of the neck of cathode ray tube. Also, the tapered threads terminate at one end in projections which act as a stop for fixing a position of the locking nut.

The locking nut can be made of synthetic resin, thereby ensuring that the locking nut will not be magnetized.

BRIEF DESCRIPTION OF THE DRAWINGS

Further features and advantages of the present invention will become apparent in the following detailed description with reference to the accompanying drawings, in which.

DETAILED DESCRIPTION

Figure 1:
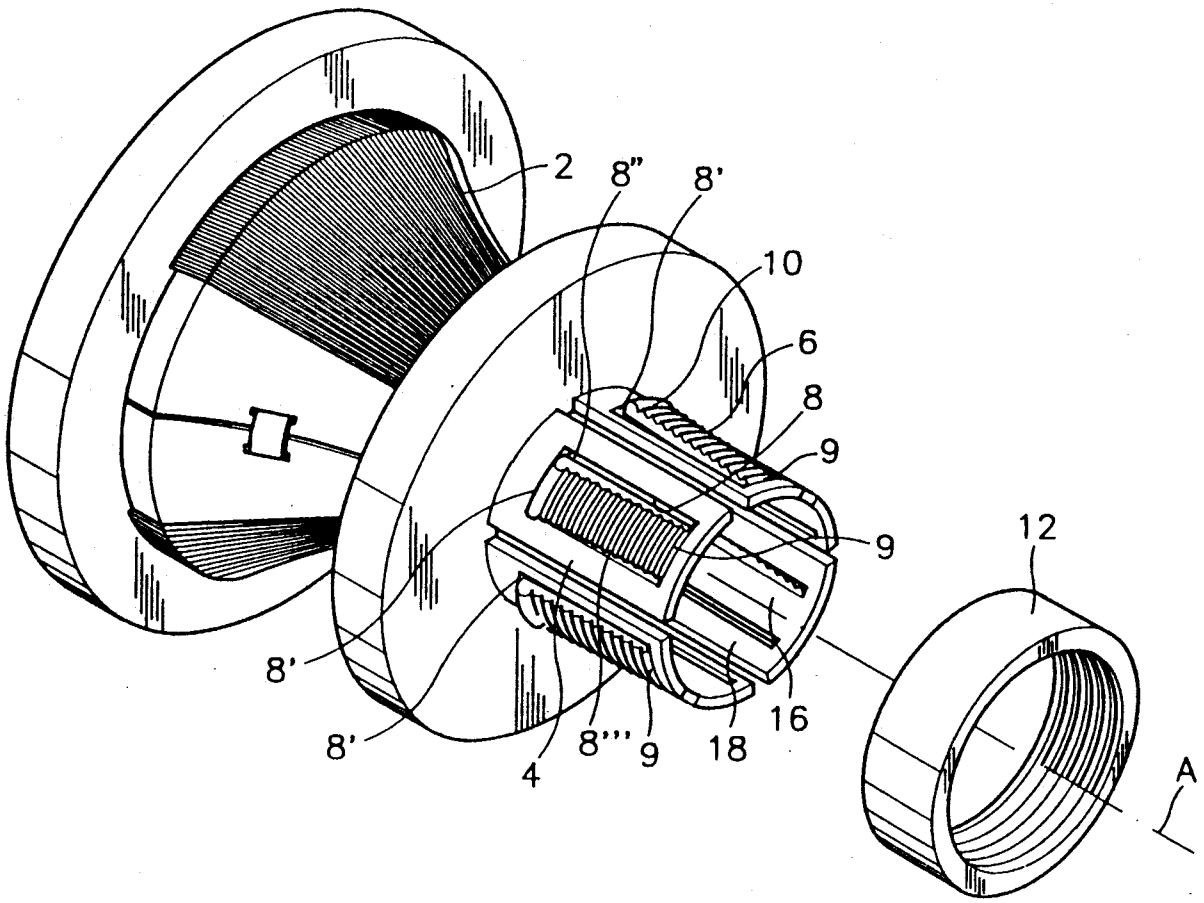
FIG. 1 is an exploded perspective view of the deflection yoke according to the present invention.

As shown in FIG. 1, a deflection yoke 2 according to the present invention has several outwardly tapered threaded members 6 on a segmented neck holder 4 of a cathode ray tube. Slots 8 are formed around three sides of the tapered members 6. Two slots 8″ and 8‴ are parallel with an axis of the deflection yoke 2, and an additional slot 8′ is cut perpendicularly at the forwardmost end of the threads and intersect slots 8″ and 8‴. Each of the members 6 is connected to the neck holder at a bottom end 9. As a result, the members can flex inward on the bottom end. Thus, the tapered thread members 6 cause members 6 to be compressed inward slightly and tightly toward the neck of the cathode ray tube, due to the resilience of the material. On the uppermost end of the members, projections 10 are formed to protrude outwardly above the neck holder.

A locking nut 12 can be threaded axially over the neck holder 4 along axis A to compress the members 6. The projections act as a stop at the end of the tapered threads, causing the locking nut 12 to stop and grip tightly in an end position, with the neck holder clamped tightly on the cathode ray tube("CRT").

Figure 2A:
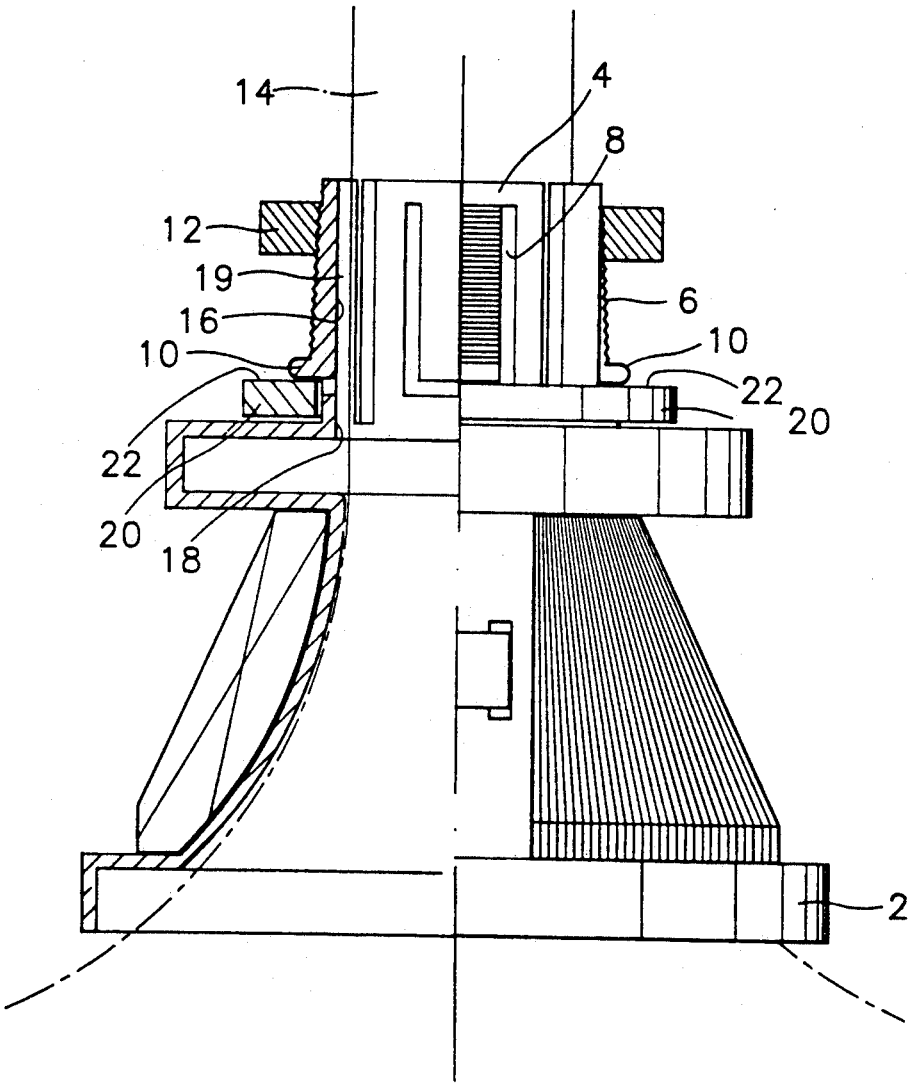
FIG. 2A is a partial section view taken on line 2—2 of FIG. 1, showing the invention before clamping.

FIG. 2A illustrates the deflection yoke of the invention mounted on the neck of the cathode ray tube before the locking nut is tightened.

If the locking nut 12 is not screwed or threaded onto the tapered threads 6 when the neck holder 4 is mounted on the neck 14 of the cathode ray tube, the deflection yoke 2 will not remain on the neck 14 of the cathode ray tube because space 19 exists between the bases 16 of the tapered threads 6 and the inside 18 of the neck holder 14.

In the above state, when the yoke is not tightened down, a worker can determine an exact position of the deflection yoke 2 by adjusting the yoke on the neck 14 of the cathode ray tube. After that, the locking nut 12 can be tightened down or throttled on the tapered threads 6.

Figure 2B:
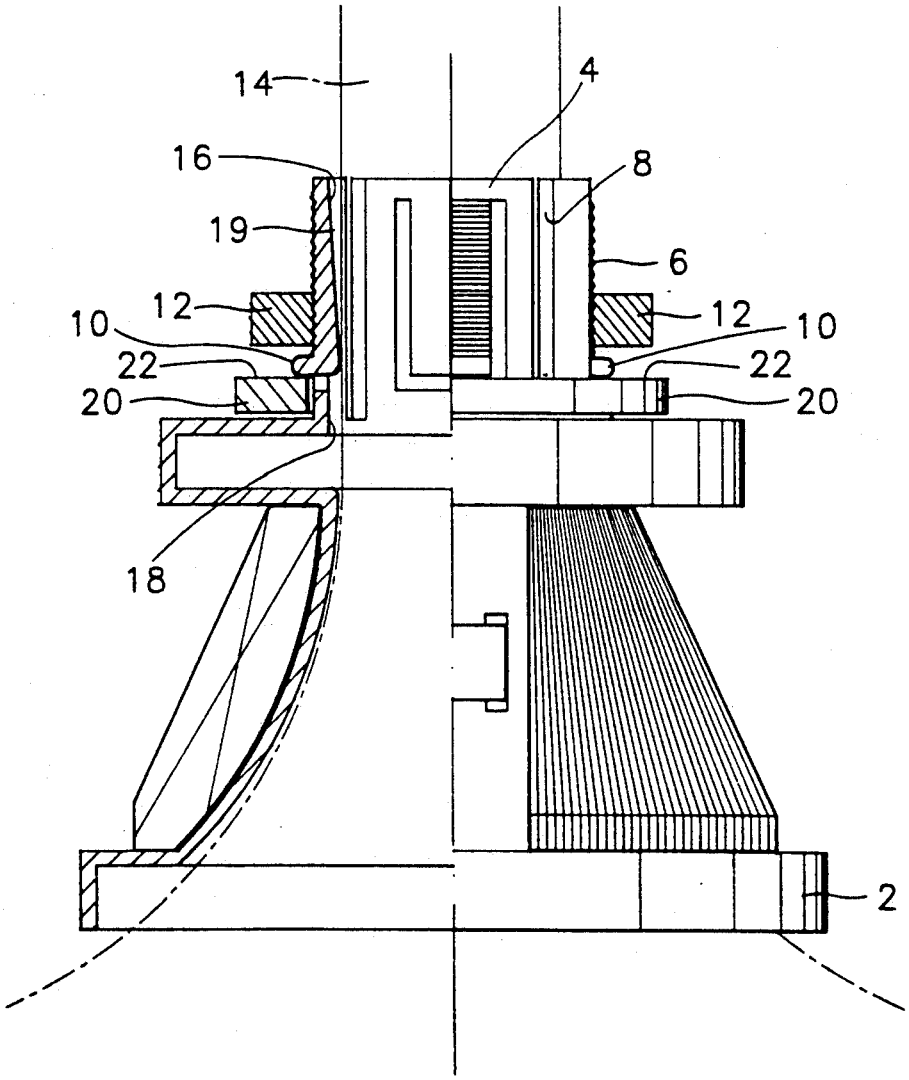
FIG. 2B is a partial section view taken on line 2—2 of FIG. 1 showing the invention after clamping.

FIG. 2B illustrates the state of fixing the deflection yoke at the periphery of the neck of the cathode ray tube.

If the locking nut 12 is screwed onto the tapered threads of members 6, the member 6 compress, the bases 16 of the tapered threads 6 are throttled at the periphery of the neck 14 of the cathode ray tube, and the deflection yoke is thereby held tightly on the CRT by members 6.

Simultaneously, the projections on the free edges of the members 6 are used to hold down a magnetic ring 20 which is put at the periphery of the neck holder 4 of the deflection yoke 2. As shown in FIG. 2B, the projections abut tightly against a rear face 22 of the magnetic ring. The magnetic ring is a conventional means of preventing magnetization of the deflection yoke.

After the deflection yoke 2 is fixed at the periphery of the neck 14 of the cathode ray tube, an adhesive is preferably applied between the tapered threads 6 and the locking nut 12 in order to prevent the locking nut 12 from loosening.

According to the present invention as described above, tapered threads are provided at the periphery of a neck holder of a deflection yoke which can be fixed at the periphery of a cathode ray tube by the locking nut compressing the tapered threads. Thus, the tapered threads provide convenient operation compared with the former clamp band. Also, since the tapered threads can be made of an unmagnetic synthetic resin, the tapered threads prevent degrading the picture quality of the cathode ray tube over time.

What is claimed is:

1. A deflection yoke having a coupler for tightly attaching the yoke to the periphery of a cathode ray tube, wherein the coupler comprises:

a neck holder having tapered compressible threaded members formed therein;

perimeter slots formed on three sides of each of the threaded members, thereby enabling compression of the threaded members; and a locking nut threadable on the threaded members for compressing the threaded members tightly toward the cathode ray tube periphery.

2. The deflection yoke as claimed in claim 1, wherein upstanding projections are formed at an end of each of the threaded members for fixing a magnetic ring.

* * * * *